United States Patent [19]

Pickles

[11] 4,235,117

[45] Nov. 25, 1980

[54] TAILGATE WINDOW REGULATOR

[75] Inventor: Joseph Pickles, Birmingham, Mich.

[73] Assignee: Ferro Manufacturing Corporation, Detroit, Mich.

[21] Appl. No.: 967,167

[22] Filed: Dec. 7, 1978

[51] Int. Cl.[3] ..... E05F 11/48; E05F 15/16

[52] U.S. Cl. ..... 74/89.2; 49/325; 49/349; 49/352; 74/501 R

[58] Field of Search ..... 49/325, 349, 352; 74/89.2, 89.21, 89.22, 501 R

[56] References Cited

U.S. PATENT DOCUMENTS

| | | | |
|---|---|---|---|
| 1,624,098 | 4/1927 | Goldsmith et al. | 74/501 R X |
| 3,392,488 | 7/1968 | Werner | 49/352 X |
| 3,566,540 | 3/1971 | Hewitt | 49/349 X |
| 3,702,041 | 11/1972 | Podolan | 49/325 X |
| 3,706,236 | 12/1972 | Pickles | 74/89.11 |

FOREIGN PATENT DOCUMENTS

| | | | |
|---|---|---|---|
| 1232839 | 1/1967 | Fed. Rep. of Germany | 49/325 |
| 2532458 | 2/1977 | Fed. Rep. of Germany | 49/352 |
| 570342 | 7/1945 | United Kingdom | 49/352 |

*Primary Examiner*—Lawrence J. Staab

*Attorney, Agent, or Firm*—Whittemore, Hulbert & Belknap

[57] ABSTRACT

A window regulator for a tailgate window comprising a pair of rotary drums each of which has associated with it a tape of sufficient flexibility to conform to the periphery of the drum. The drums are mounted on a flanged support member, the flanges defining with the drums arcuate channels in which the tape is confined. The two drums are each provided with tooth portions in mesh with each other so that the two drums rotate in opposite directions, thus imparting longitudinal movement to the tapes. A drive pinion, preferably motor driven, is in mesh with the tooth portion of one of the drums.

8 Claims, 4 Drawing Figures

TAILGATE WINDOW REGULATOR

BRIEF SUMMARY OF THE INVENTION

The present invention has for its object the smooth raising and lowering of a relatively wide tailgate window. Windows of this type preferably extend substantially completely across the width of the tailgate. In order to provide smooth opening and closing movement of the window it is essential to provide equal movement of the opposite ends of the window.

For this purpose the present invention provides a pair of interconnected drums mounted on a support having generally cyllindrically formed flange portions which are closely adjacent to the peripheries of the drums and define arcuate guide passages therewith for the reception of window actuating tapes. The tapes are each fastened at one end to a peripheral portion of a drum and have only sufficient flexibility to permit rotation of the drum to wind the tape up on the drum or to unwind the tape from the drum and to push it through an opening in a window provided in the associated flange.

The drums are preferably formed as parts of rotors of plastic material and in addition to the cylinder drum portion thereof, each is provided with a concentric gear portion by means of which the two drums are geared together for simultaneous equal rotation in opposite directions.

Attached to the support are a pair of substantially rigid elongated guides shaped to conform to the tape and to guide the portion of the tape exterior of the housing formed by the drum and support as it is pushed or pulled through the associated window by rotation of the drum to which it is attached.

Conveniently the tape may be of generally flat elongated shape having at its opposite edges flange portions extending outwardly and thence inwardly leaving a space between the adjacent ends thereof. The tape supports may be of T-shaped cross-section in which the cross-section of the T is received between the flat portion of the tape and its flange portions, and the stem of the T which extends outwardly through the channel between the adjacent ends of the flange portion.

The ends of the tapes opposite to the ends which are secured to the rotatable drums are provided with connectors by means of which the tapes are connected to lower edge portions of the tailgate window adjacent the lateral edges thereof. Preferably these connectors are pivotally connected to the tapes and the window.

The elongated preferably T-shaped support guides, while substantially rigid in use, may nevertheless be given a slight curvature during formation so as to conform the supports to the desired path of the lower edge portion of the window. As a result the window may be moved upwardly in a slightly curved path as desired.

Preferably power means are provided for rotating the drums and this comprises an electric motor having a worm connected thereto through a yieldable driving connection, the worm being in mesh with a worm gear drivably connected to a pinion in mesh with the gear portion of one of the rotors.

The present invention is related to my prior co-pending application Ser. No. 930,376 and to my prior U.S. Pat. No. 3,706,236.

GENERAL DESCRIPTION

Figure 1:
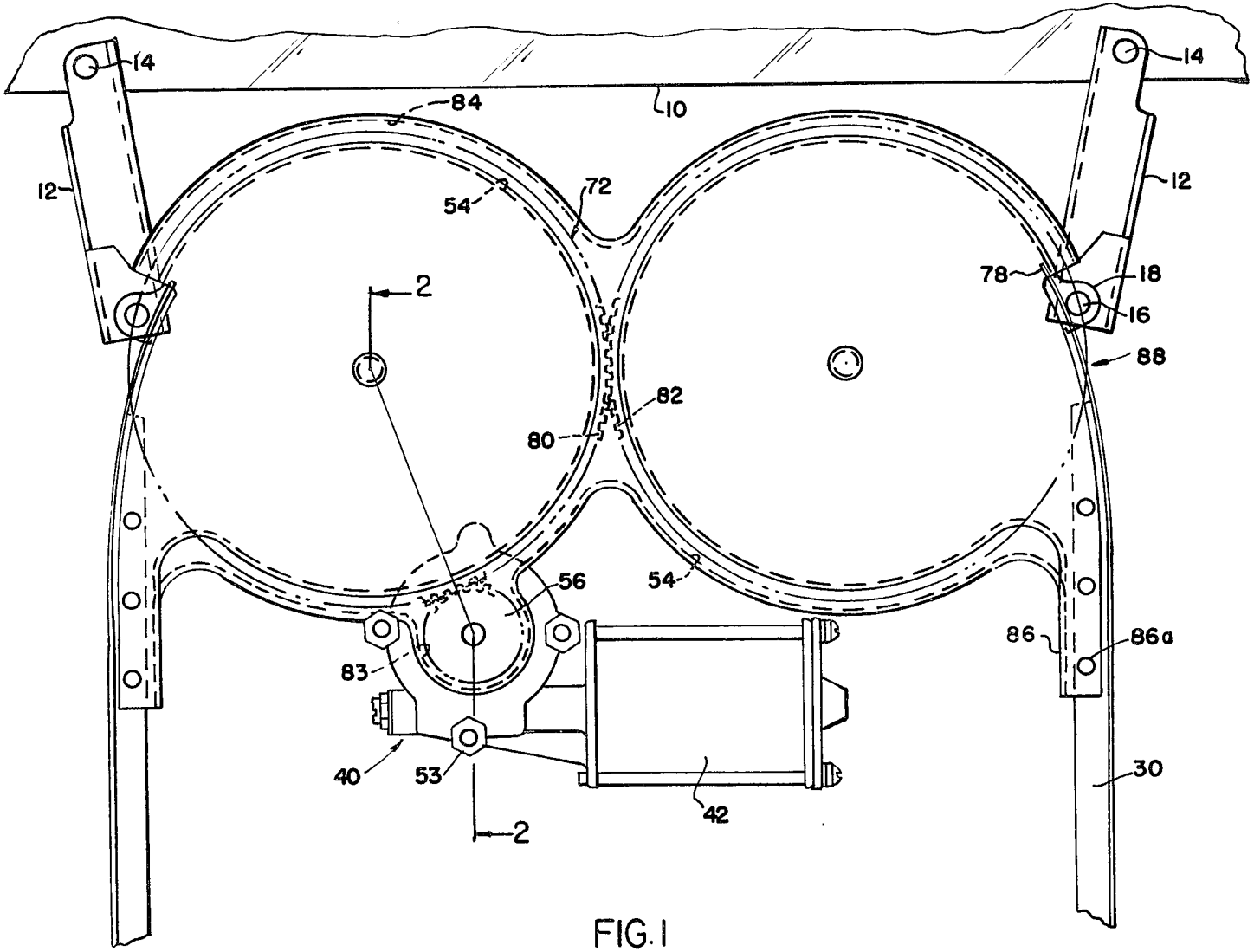
FIG. 1 is an elevational view of the operating part of the window regulator.

Referring now to the drawings the actuating mechanism is contained within the lower portion of the tailgate, which is not illustrated herein and is connected to the tailgate window 10 by suitable connectors 12 pivoted to the lower edge portion of the window as indicated at 14 and pivoted to the end of the tape exterior of the housing structure as indicated at 16. The pivot connections 14 and 16 provide for freedom of movement as the pivot connection 16 departs from the path of the pivot connection 14.

The pivot connection 16 is in the form of a pivot pin extending through an apertured block 18 secured to or formed at the end portion of the tape.

Figure 3:
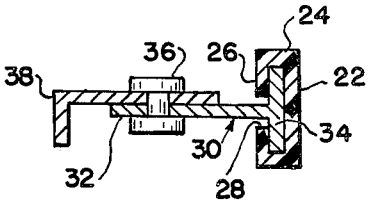
FIG. 3 is a sectional view through the tape and its elongated guide support.

Referring now to FIG. 3 the tape is indicated generally at 20 and comprises a flat elongated portion 22 having at its edges and extending laterally therefrom flange portion 24 connected to inwardly extending flange portions 26. The inner ends of the flange portion 26 are spaced apart and provide an unobstructed longitudinal extending passage or channel 28 for a purpose to be described.

The flexible tape 20 is preferably formed of a suitable plastic material and due to the selection of material and to its configuration is fairly rigid but is capable of being bent into a circular arc around the periphery of an actuating drum, later to be described.

The flexible tape 20 has one end fixedly secured to its actuating drum and its other end extends out of a housing structure onto a functionally rigid guide 30, which is as shown of T-shape cross-section having a stem 32 which extends out of the channel 28 and connects to the cross member 34 on which the flexible tape is longitudinally slidable.

The T-shape guide 30 has support brackets 38 connected thereto by rivets 36, which brackets are fastened to the interior of the tailgate.

A regulator support indicated in its entirety at 40 is mounted by suitable bolts or the like to the interior of the tailgate and constitutes a support for the electric motor 42, actuation of which raises and lowers the tailgate window. The motor 42 has an output shaft 44 terminating in a driving worm 46 which is in mesh with a worm gear 48 received in a cup-shaped housing 50, having a closure plate 51. An actuator support plate 52, having an overall configuration best illustrated in FIG. 1, is rigidly connected to the support 40, specifically to the housing 50 thereof by bolts 53. The plate 52 has a first cylindrical peripheral flange 54 which surrounds a substantial angular extent of both rotors 72 and defines therewith tape guiding and confining passages 55. The cylindrical flange 54 has a radially outwardly extending flat flange **55*a*, which is spaced slightly from the side of the gear portions of the rotors, later to be described. In the vicinity of the support 40, the flange 55*a* of plate 52 has a lateral extension 56 apertured at 58 to receive one end of shaft 60, on which the worm gear 48 is rotatably mounted. Shaft 60 has its other end fixed in a thickened portion 62 of housing 50**.

Figure 2:
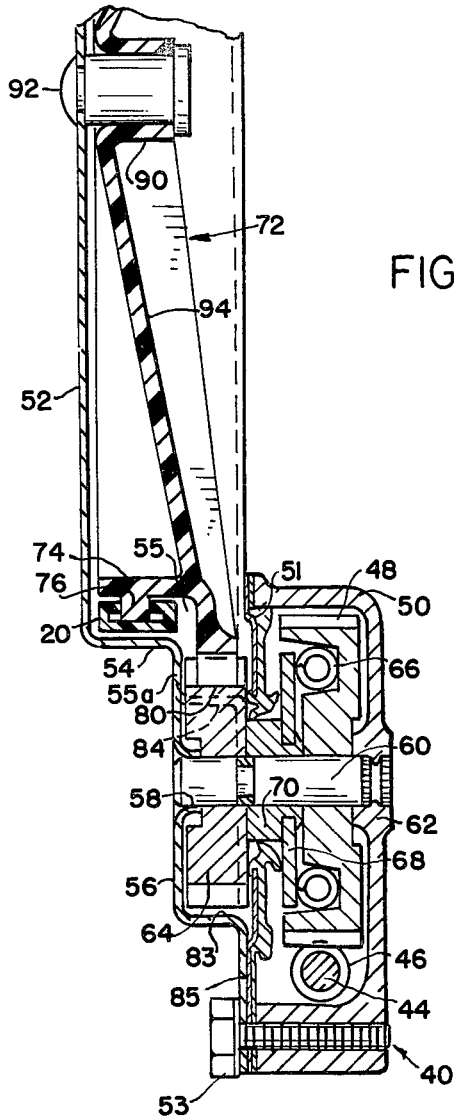
FIG. 2 is an enlarged fragmentary section on the line 2—2, FIG. 1.

The worm gear 48 is mounted for rotation on the shaft 60 and is coupled to a drive pinion 64 by a yieldable drive connection including compression springs 66 and arms (not shown) carried by a spider 68 fixed to a hub portion 70 of the pinion 64. The support plate 52 carries two rotors, details of which are best illustrated in FIG. 2. The rotors, indicated in their entirety at 72 are each integrally formed of plastic material and include generally cylindrical peripheral drum portions 74 provided with a radially outwardly projecting guide flange 76 adapted to extend into the channel 28 provided in the flexible tape 20, as clearly seen in this Figure.

It will be observed that the flange 54 is closely adjacent to the drum 74 and defines therewith passage 55, so that the portion of the tape within the passage is guided and retained therein against outward bowing under compression. As a result the tape 20, although flexible, can be used as a push-pull actuator. This is because the portion of the tape in contact with the drum is confined in the annular guide passage 55 between the flange 54 and the drum 74. As the tape is pushed outwardly through an opening or gap in the flange 54 it is pushed onto the inner end 78 of the cross portion 34 of the tape support 30.

Referring again to FIG. 2 it will be observed that the rotors 72 are provided with peripheral gear portions 80, one of which meshes with the drive pinion 64. The gears 80 of the two rotors, as best seen in FIG. 1, are in mesh with each other at a zone indicated at 82 so that equal and opposite rotation of the rotors 72 and drums 74 is provided.

Support plate 52 is provided with a cylindrical peripheral flange 83 at its lateral extension 56 which surrounds pinion 64 except where the pinion meshes with gear 80. This flange then continues around plate 52 as indicated at 84, surrounding gears 80 except where these gears mesh at the zone 82. Flange 83 has a flat mounting flange 85 bolted to housing 50 and constituting the means for mounting plate 52 and all structure carried thereby on the support 40. It will be noted that while support plate 52 is generally flat, it is provided with flanges 54 and 84, as well as short flange 83, all of which are perpendicular to the plane of the central large flat area of plate 52. These flanges, together with flat flange portions 56 and 85, all contribute to stiffening and reinforcement of the support plate 52.

The upper end of each of the T-shaped supports 30 is fixed to a flanged tangential extension 86 of plate 52 as indicated at **86*a* and the cross portion 34 of the guide extends through a window in the flange provided at the zone 88. Accordingly the flexible tape is guided into the annular chamber between the flange 54 and drum 74** and onto the outer cylindrical surface of the drum.

The lower end of the T-shaped guides 30 are rigidly affixed to suitable support brackets within the tailgate and thus the guides 30 provide substantial additional support to the actuator support plate 52.

It will be observed that the rotor 72 is provided with a tubular flange or hub 90 which supports the rotor for rotation on a pivot pin 92 carried by a central portion of the flat support 52. At the periphery of the rotor the drum 74 is conncted to the central tubular flange 90 by an inclined conically formed web portion 94 which provides a substantially rigid connection between the central bearing portion 90 and the peripheral drum 74 and gear 80. Hub 90 and drum 74 are substantially coextensive axially.

More generally it will be noted that drum portion 74 and gear portion 80 together constitute a circular rim of substantial axial extent and that the drum and gear portions are axially separated. The hub portion 90 is located between the planes containing the edges of the rib.

Figure 4:
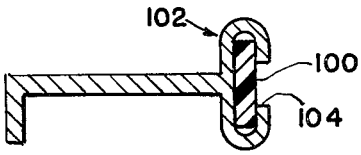
FIG. 4 is a view similar to FIG. 3, showing a different form of tape and guide.

In FIG. 4 there is illustrated a second embodiment of push-pull tape, here designated 100. The tape 100 is of simple rectangular cross-section, having a width several times its thickness, so that flexibility of the tape is limited to bending in a direction perpendicular to its thickness. The tape guide 102 comprises a generally C-shaped channel conforming closely to the tape and guiding it for longitudinal sliding movement. The channel has an elongated slot 104 through which a coupler on the end of the tape extends and is movable longitudinally of the tape guide. The guide has a stem 106 corresponding to stem 32. The outer periphery of the drum 74 may be grooved to receive the tape, and the flange 76 of course omitted.

Accordingly there is provided a simple inexpensive yet rugged and trouble-free window regulator adapted to impart equal movement to widely spaced end portions of a relatively wide tailgate window.

What is claimed is:

1. A tailgate window regulator adapted to be mounted within the interior of a vehicle tailgate for connection to a window movable into and out of the interior of the tailgate, said regulator comprising a pair of rotors, each of said rotors comprising a unitary concentric axially offset gear and tape actuating drum, the gears of said rotors being slightly larger than said drums and being in mesh, a support comprising a flat plate on which said rotors are pivotally mounted, said plate having two generally circular portions joined at their edges and of slightly greater diameter than said drums, generally cylindrically shaped flanges at the edges of said circular portions surrounding a substantial circumferential extent of the adjacent drums and defining therewith generally arcuate tape confining and guide passages, operationally rigid elongated tape guides connected to and extending from said support in generally tangential relation to said drums, flexible tapes having one end fixedly connected to said drums and having window connector brackets at the other ends thereof, said tapes and guides having interfitting configurations providing for only longitudinal sliding of the tapes on said guides, and drive means for rotating one of said rotors whereby said tapes are wound onto or off of said drums to raise or lower the tailgate window.

2. A tailgate window regulator as defined in claim 1, said drive means comprising an electric motor, a worm connected to said motor, a worm gear in mesh with said worm, a pinion in mesh with one of said gears and a drive connection between said worm gear and pinion.

3. A tailgate window regulator as defined in claim 2, said support having a flat flange extending outwardly from said first generally cylindrically shaped flanges closely adjacent to the side portions of said gears, and second generally cylindrically shaped flanges closely spaced from and surrounding substantial portions of said gears.

4. A tailgate window regulator as defined in claim 3, in which said first flange has openings at opposite ends of said plate through which said tapes move as they are wound onto or wound off of said drum.

5. A tailgate window regulator as defined in claim 3, in which said second flange extends around the peripheries of said gears except for the zone in which said gears mesh with each other.

6. A tailgate window regulator as defined in claim 3, in which said flat flange has a lateral coplanar extension, a drive pinion rotatably supported at one side of said extension in mesh with the adjacent one of said gears, said second generally cylindrically formed flange being shaped to surround substantially more than 180° of said pinion and having at its edge remote from said first cylindrical flange a flat mounting flange, a cup shaped housing secured to said mounting flange, a worm gear in said housing, a worm in mesh with said worm gear, and a motor fixedly mounted on said housing and having a drive shaft extending into said housing and connected to said worm.

7. A tailgate window regulator as defined in claim 6, in which the mounting flange constitutes the means for interconnecting the support plate and housing and the motor carried thereby.

8. A tailgate window regulator as defined in claim 1, in which each of said rotors comprises a central tubular pivot mounting, and a conical web connecting one end of said tubular pivot mounting with the opposite end of said drum.

* * * * *